US006152775A

United States Patent [19]

Pavlovic

[11] Patent Number: 6,152,775

[45] Date of Patent: Nov. 28, 2000

[54] FILTERED ELECTRICAL CONNECTOR WITH MULTIPLE FERRITE MEMBERS

[75] Inventor: Slobodan Pavlovic, Canton, Mich.

[73] Assignee: Framatome Connectors Interlock, Inc., Westland, Mich.

[21] Appl. No.: 09/206,681

[22] Filed: Dec. 7, 1998

[51] Int. Cl.[7] ..... H01R 13/66

[52] U.S. Cl. ..... 439/620; 439/441

[58] Field of Search ..... 439/620, 441, 439/552; 102/530, 202.2

[56] References Cited

U.S. PATENT DOCUMENTS 5,200,574 4/1993 Cunningham et al. ..... 102/530
5,213,522 5/1993 Kojima ..... 439/620
5,241,910 9/1993 Cunningham et al. ..... 102/530
5,397,250 3/1995 Briones ..... 439/620
5,489,220 2/1996 Hanna et al. ..... 439/620
5,586,902 12/1996 Hopf et al. ..... 439/352

*Primary Examiner*—Paula Bradley
*Assistant Examiner*—Alexander Gilman
*Attorney, Agent, or Firm*—Perman & Green, LLP

[57] ABSTRACT

An electrical filter connector having a housing, electrical contacts, and ferrite hoods. The ferrite hoods separately surround portion of individual respective ones of the contacts. The housing can be over-molded onto the contacts to function as a strain relief for conductors attached to the contacts.

11 Claims, 3 Drawing Sheets

FILTERED ELECTRICAL CONNECTOR WITH MULTIPLE FERRITE MEMBERS

BACKGROUND OF THE INVENTION

1. Field of the Invention

The present invention relates to electrical connectors and, more particularly, to filtered electrical connectors having ferrite members.

2. Prior Art

U.S. Pat. No. 5,489,220 discloses a filter connector with a ferrite barrel for two electrical contacts. U.S. Pat. No. 5,213,522 discloses a filtered connector with a multi-piece ferrite block. A problem with these types of ferrite blocks is that they must be made of electrically non-conductive ferrite oxide to prevent short-circuiting of the contacts and, therefore, cannot filter lower frequencies (about $1 \leqq 50$ $MH_z$) without increasing length of the ferrite block and thereby increasing the size of the connector. For a filtered connector intended to be used in a small space, such as an air bag connector, increasing the size of the connector is not desired. If an electrically conductive ferrite oxide material needed to be used for lower frequency attenuation, such as about 1–150 $MH_z$, electrical insulators would need to be added between the contacts and the ferrite block.

SUMMARY OF THE INVENTION

In accordance with one embodiment of the present invention an electrical filter connector assembly is provided comprising first electrical terminals, ferrite hoods, and second electrical terminals. The first electrical terminals have female contact areas. The ferrite hoods are separately mounted on respective ones of the first terminals over the female contact areas. The second electrical terminals have male contact areas located in the female contact areas of the first terminals.

In accordance with another embodiment of the present invention a filter connector is provided comprising a housing, first electrical terminals, and ferrite hoods. The housing has separate contact locating holes. The first electrical terminals have female contact areas located in respective ones of the contact locating holes. The ferrite blocks are located in respective ones of the contact locating holes separately surrounding the female contact areas of respective ones of the first terminals.

In accordance of another embodiment of the present invention an electrical filter connector is provided comprising first electrical terminals, ferrite hoods, and a housing. The first electrical terminals have female contact areas. The ferrite hoods are mounted on respective separate ones of the female contact areas. The housing is molded over the ferrite hoods to maintain the ferrite hoods and their respective female contact areas in a spaced relationship to each other.

In accordance with one method of the present invention a method of manufacturing an electrical filter connector is provided comprising steps of placing ferrite hoods over respective separate contact areas of first electrical terminals; and molding a housing over the ferrite hoods to maintain the ferrite hoods in a spaced relationship to each other. The ferrite hoods maintain the female contact areas in a spaced relationship to each other.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
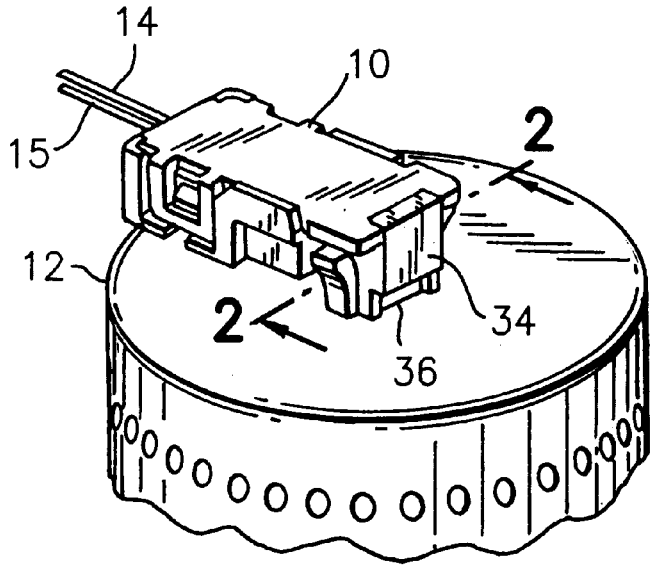
FIG. 1 is a perspective view of an electrical connector incorporating features of the present invention attached to an air bag gas generator.

Referring to FIG. 1, there is shown a perspective view of an electrical connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
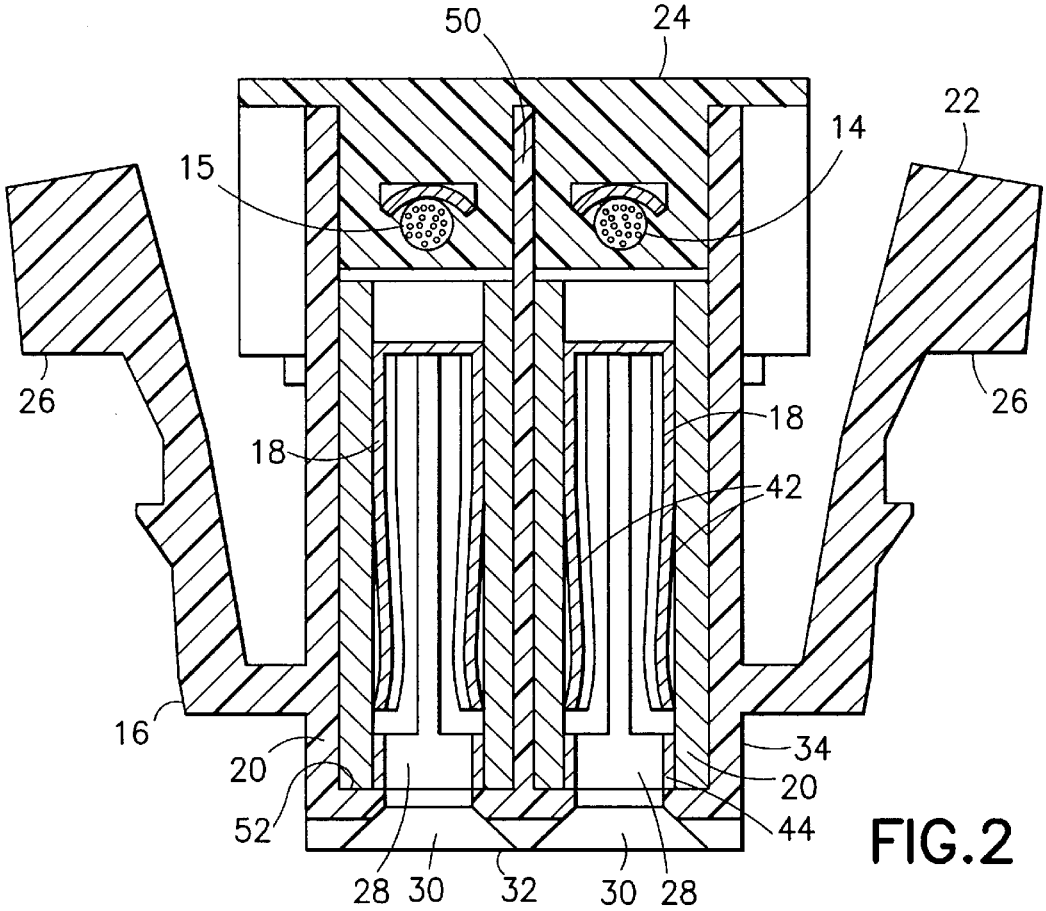
FIG. 2 is a cross-sectional view of the electrical connector shown in FIG. 1.

The connector 10, in this embodiment, is for use in connecting electrical conductors 14, 15 with an air bag gas generator 12. However, the connector 10 could be used to connect conductors with other devices. Referring also to FIG. 2, the connector 10 generally comprises a housing 16, electrical contacts 18 and ferrite hoods 20. The housing 16 comprises a first housing piece 22 and a second housing piece 24. The first housing piece 22 includes two cantilevered finger actuatable deflectable latches 26, two separate receiving areas 28, and two holes 30 through a bottom face 32 of the housing into the receiving areas 28. The housing 16, at the bottom of the front section 34, is adapted to be plugged into a socket 36 of the gas generator 12. The latches 26 are adapted to latch with latch surfaces in the socket 36. Preferably, additional connector position assurance means is provided to prevent the connector 10 from accidentally being disengaged from the gas generator 12. The second housing piece 24 is preferably molded onto the first housing piece 22 after the contacts 18 and ferrite hoods 20 are located in the receiving areas 28. However, in alternate embodiments other types of housings or housing components could be provided.

Figure 3:
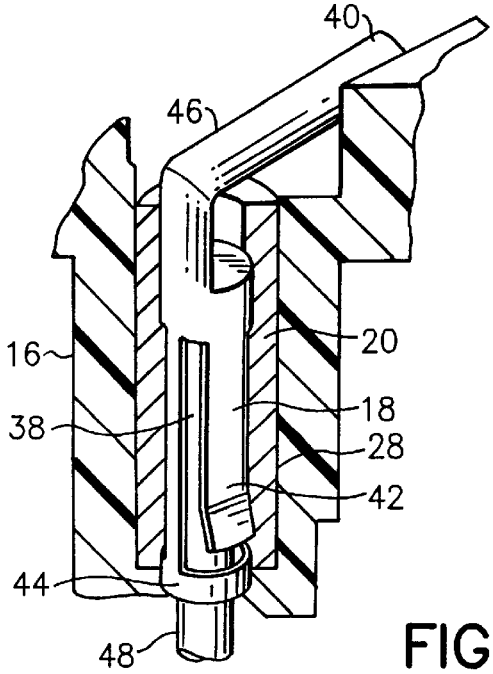
FIG. 3 is a partial perspective cut-away view of the connector shown in FIG. 1.

Referring also to FIG. 3, the electrical contacts 18 each comprise a female contact area 38 and a connection area 40 for connection to the electrical conductors 14, 15. Preferably, the contacts 18 are comprised of stamped and formed sheet metal. The female contact area 38 has two spring contact arms 42 and a leading end positioner 44. A lead section of 46 of each contact 18 extends between the female contact area 38 and the conductor connection area 40. In this embodiment the lead section 46 has a 90° bend for a right angle connector. However, the lead section could be straight for an in-line connector. The conductors 14, 15 could be crimped, soldered or welded to the connector areas 40. The socket 36 has two male pin contacts 48 (only one of which is shown in FIG. 3) at a fixed spacing relative to each other that are received in the two female contact areas 38 through the holes 30 in the housing 12. Thus, the contacts 18 are able to electrically connect the contacts 48 to the conductors 14, 15.

The ferrite hoods 20 are provided as two separate members. In a preferred embodiment the ferrite hoods 20 have tube shapes and are comprised of the same material, such as electrically conductive ferrite oxide. However, the hoods could have different shapes, could be comprised of electrically non-conductive ferrite oxide, and/or the hoods could be made of differing materials; such as one hood being made of electrically conductive ferrite oxide and the other hood being made of electrically non-conductive ferrite oxide. In the embodiment shown, the two receiving areas 28 are separated by a wall 50 of the housing 16. The bottoms of the receiving areas 28 have shelves 52 surrounding the holes 30 that allow the end positioners 44 and ferrite hoods 20 to be positioned against. The ferrite hoods 20 are matingly received in the separate receiving areas 28. The female contact areas 38 are received inside respective ones of the hoods 20. Preferably, there is a friction fit between the contacts 18 and the hoods 20 when the contacts are inserted into the hoods 20. When the contacts 18 are connected to the conductors, the hoods 20 placed on the contacts 18, and the hoods and contacts placed in the first housing piece 22, the second housing piece 24 is then molded onto the first housing piece 22 to capture the contacts and hoods in place at a fixed relationship to each other. The over-molded second housing piece 24 also provides strain relief for the conductors 14, 15. In an alternate embodiment the second housing piece 24 need not be over-molded.

By providing each contact 18 with its own separate and spaced ferrite hood 20, the hoods 20 can now be comprised of electrically conductor ferrite oxide, such that: certain frequencies can be attenuated which otherwise could not be attenuated with electrically non-conductive ferrite oxide. The shapes of the hoods 20 are optimized for maximum efficiency such that excess ferrite oxide material is not used as in U.S. Pat. No. 5,489,220. Compared to the ferrite block in U.S. Pat. No. 5,489,220, about 75 percent less ferrite material can be used. This can obviously reduce the size of the overall connector. Thus, cost and weight and size of the connector can be minimized. The present invention allows two different ferrite oxide materials to be used in the same connector, such is one for high frequency attenuation and one for low frequency attenuation for a better or wider range of filtering. Even though the ferrite hoods 20 can be made of electrically conductive material, they can still be mounted directly on the contacts 18 without use of an insulator between the two because the two ferrite hoods 20 are electrically separated from each other. When attempting to reduce the size of a filter connector using a ferrite block by making the ferrite block smaller more filtering problems would be expected to be encountered. The present invention provides a means to reduce the size of the connector while maintaining good filtering by providing separate hoods for each contact and by optimizing the length and width of each hood 20 for the best filtering without unnecessary ferrite oxide material. A direct mechanical connection between the contacts 18 and hoods 20 also makes assembly easier and less expensive regardless of whether the hoods 20 are comprised of electrically conductive or non-conductive material. The present invention can also be combined with a coil filter in the connector if desired, and is preferably used with a shorting bar in the socket 36. Preferably, the hoods 20 are comprised of metal powder which is pressed into a mold and sintered into shape. Alternative manufacturing, such as extrusion could also be used. If the housing allows for servicing by opening or removing the housing, the contacts can be reused by merely disconnecting the hoods 20 from the contacts 18 and attaching new ferrite hoods. Thus, the connector 10 is serviceable after the gas generator 12 is used.

Figure 4:
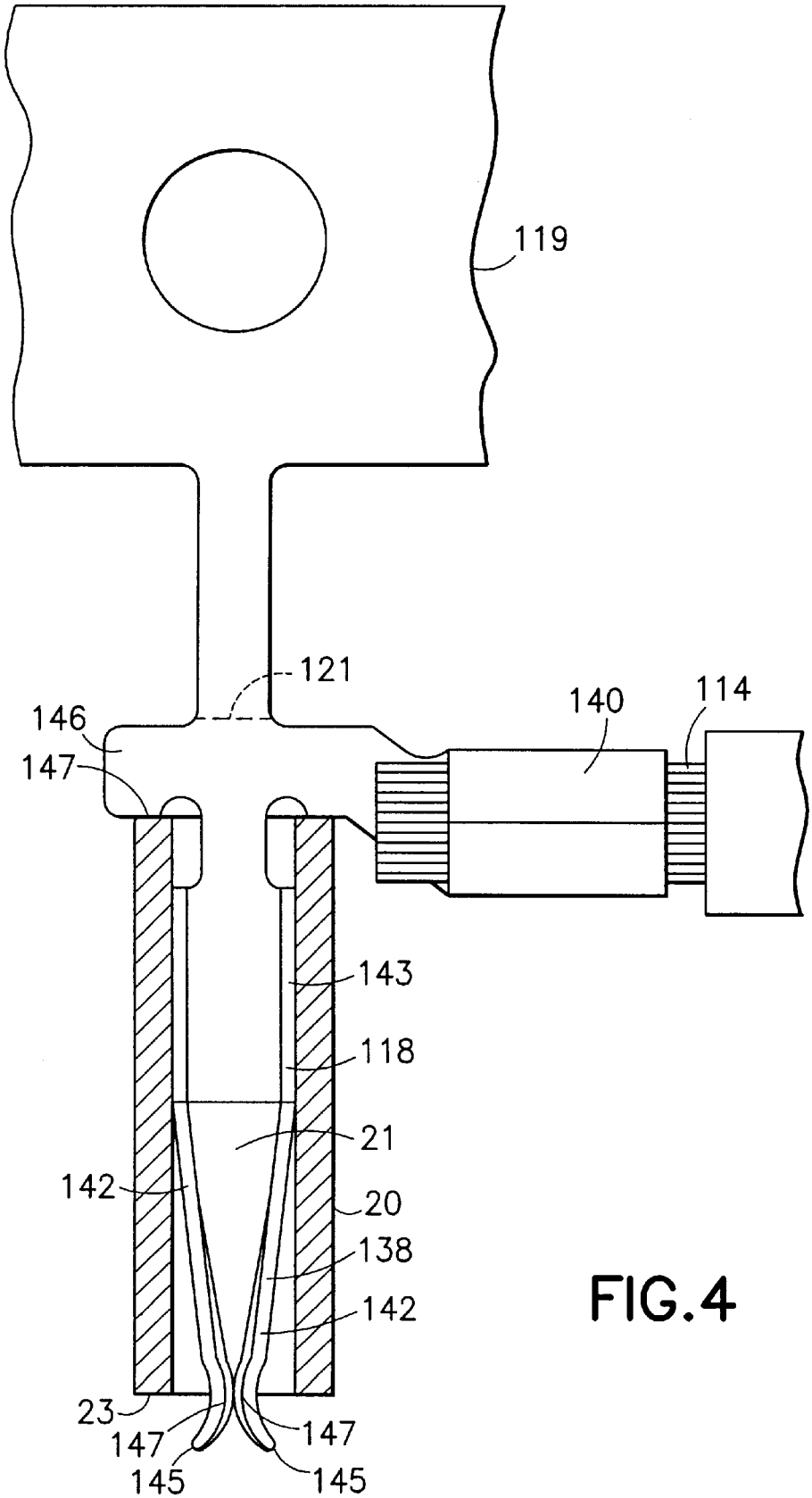
FIG. 4 is a front elevational view of an alternate embodiment of a contact terminal on a carry strip and attached to an electrical conductor with a cross-sectional view of a ferrite tube mounted on the terminal.

Referring now to FIG. 4 an alternate embodiment of the contact is shown. The contact 118 is comprised of sheet metal initially attached to a carry strip 119. The contact 118 is eventually severed from the carry strip at 121. The contact 118 has a female contact receiving area 138, a lead section 146, and a conductor connection area 140 for connection to the conductor 114. The lead section 146 provides a right angle between the receiving area 138 and the connection area 140 for a right angle connector. The lead section 146 also provides a stop surface 147 facing the receiving area 138. The receiving area 138 has cantilevered contact spring arms 142 and a section 143 for connection to the hood 20. The section 143 is sized and shaped to be press fit into the channel 21 through hood 20 to friction fit mount the hood on the contact 118. Alternative or additional connection means could be used. An electrical insulator could also be provided between the hood and the contact, but is unnecessary if the two hoods in the connector are kept separate from each other or are electrically non-conductive. The stop surface 147 allows the hood to be precisely mounted on the contact 118. Ends 145 of the arms 142 and their contact areas 147 can thus be precisely located relative to the hood 20 and its end 23. This can help to optimize the smallest length of the hood 20 to provide the best filtering possible for the contact with the least amount of ferrite material being used; thereby reducing the size of the connector. Assembly of the hood 20 on the contact 118 also provides a unitary assembly for easily insertion into a housing as a singular unit.

Figure 5:
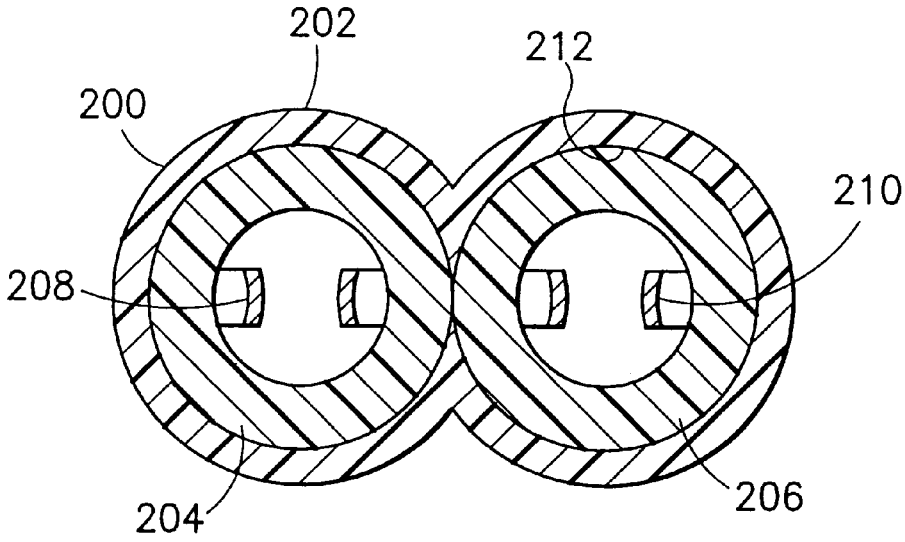
FIG. 5 is a cross-sectional view of a plug section of an alternate embodiment of the connector.

Referring now to FIG. 5, a cross-sectional view of another alternate embodiment is shown. The connector 200 has a housing 202 comprised of dielectric plastic, two ferrite hoods 204, 206, and two electrical contacts 208, 210 for receiving parallel male contact pins (not shown) In this embodiment the housing 202 has a single receiving area 212. The two hoods 204, 206 are placed in the area 212 side-by-side and touch each other. At least one of the hoods 204, 206 is comprised of electrically non-conductive ferrite oxide. At least a portion of the housing 212 could be molded onto the hoods 204, 206.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical filter connector assembly comprising:

a housing adapted to be plugged into a socket of a gas generator, the housing comprises at least one contact locating hole first electrical contact terminals having a wire connection area and a female contact area, the terminals being located in the at least one contact locating hole;

ferrite hoods separately mounted on respective ones of the first terminals over the female contact areas, the ferrite hoods each having a general tube shape, the female contact areas being adapted to mate at the gas generator socket with second electrical terminals having male contact areas, wherein the female contact areas each have cantilevered contact spring arms, the spring arms being received in the ferrite hoods, and wherein the ferrite hoods are comprised of different materials.

2. An assembly as in claim 1, wherein the first female contact terminals are provided with a lead section between the conductor connection area and the female contact area, the lead section providing a right angle between the female contact areas and the conductor connection area, the lead section further providing a first stop surface, wherein the at least one receiving area has a bottom provided with a shelf surrounding a hole provided to receive the male contact area, the shelf providing a second stop surface wherein at least one of the ferrite hoods is retained between the first and second stop surfaces.

3. An assembly as in claim 1 wherein the female contact areas comprise a section for connection to the hoods and wherein there is a friction fit between the female contact areas and the ferrite hoods.

4. An assembly as in claim 1 wherein the housing comprises two of the contact locating holes, each hole receiving one of the female contact areas and one of the ferrite hoods.

5. An assembly as in claim 1 wherein the housing has a single contact locating hole, the ferrite hoods being placed side by side and touching each other in the contact locating hole.

6. An assembly as in claim 5 wherein the ferrite hoods are respectively comprised of the different materials which have different respective frequency attenuations.

7. An assembly as in claim 5 wherein at least one of the ferrite hoods is made of an electrically non-conductive material.

8. An assembly as in claim 4 wherein the ferrite hoods are respectively comprised of the different materials which have different frequency attenuations.

9. An electrical filter connector assembly comprising:

a first housing piece provided with contact locating holes;

tubular ferrite hoods, at least two of the hoods having different frequency attenuations;

first electrical contact terminals each provided with a female contact area inserted in respective ones of the tubular ferrite hoods, a lead section between a conductor connection area and the female contact area, the lead section providing a right angle between the female contact areas and the conductor connection area, the female contact area and its respective ferrite hood being received in one of the locating holes, wherein the first housing piece receives two of the first electrical contact terminals, wherein, upon mating with pin contacts of a socket, the ferrite hoods each surround one of the mated pin contacts and one of the female contact areas.

10. An assembly as in claim 9 wherein the female contact areas comprise a section for connection to the hoods and wherein there is a friction fit between the female contact areas and the ferrite hoods.

11. An assembly as in claim 10 further comprising a second housing piece which closes an opening in the first housing piece and captures the contacts and hoods in place at a fixed relationship.

* * * * *